United States Patent [19]

McMurray

[11] 4,453,685

[45] Jun. 12, 1984

[54] MAIL BOX BRACE

[76] Inventor: Bunny D. McMurray, Rte. 3, Box 23, Winnsboro, La. 71295

[21] Appl. No.: 239,388

[22] Filed: Mar. 2, 1981

[51] Int. Cl.[3] ..... A47G 23/02

[52] U.S. Cl. ..... 248/146; 232/39

[58] Field of Search ..... 248/146, 145, 300, 219.2, 248/226.3, 295.1; 232/38, 39, 17

[56] References Cited

U.S. PATENT DOCUMENTS

| | | | |
|---|---|---|---|
| 1,281,062 | 10/1918 | Norvell | 248/146 |
| 2,534,163 | 12/1950 | Enghauser | 232/38 X |
| 2,970,799 | 2/1961 | Pinson | 248/230 |
| 3,272,465 | 9/1966 | Baarsgard | 248/145 |
| 3,958,351 | 5/1976 | Summey | 248/230 |
| 4,105,180 | 8/1978 | Hodge | 232/39 X |
| 4,130,239 | 12/1978 | Belsheim | 232/39 |
| 4,182,362 | 1/1980 | Hewson et al. | 137/340 |

*Primary Examiner*—William H. Schultz

*Assistant Examiner*—Ramon O. Ramirez

*Attorney, Agent, or Firm*—Blair, Brown & Kreten

[57] ABSTRACT

Disclosed herein is a mailbox brace which includes a horizontal planar shelf upon which an end portion of the mail box rests, an inverted U-shaped strap overlying the mail box above the shelf portion and fastened to the shelf by means of outwardly turned horizontal flanges through nuts and bolts, a vertical plate joined to the shelf at respective edges thereof so that a substantially L-shaped bracket in cross section is formed, in which the vertical plate is affixed to a support post by means of screws, or by means of a horseshoe clamp which straddles the post and the vertical plate having an aperture plate disposed on a face of the vertical plate opposite the post so that the horseshoe clamp termini pass therethrough. The termini are threaded and suitable nuts are provided for affixing the horseshoe clamp in a secure manner.

5 Claims, 2 Drawing Figures

MAIL BOX BRACE

BACKGROUND OF THE INVENTION

Figure 1:
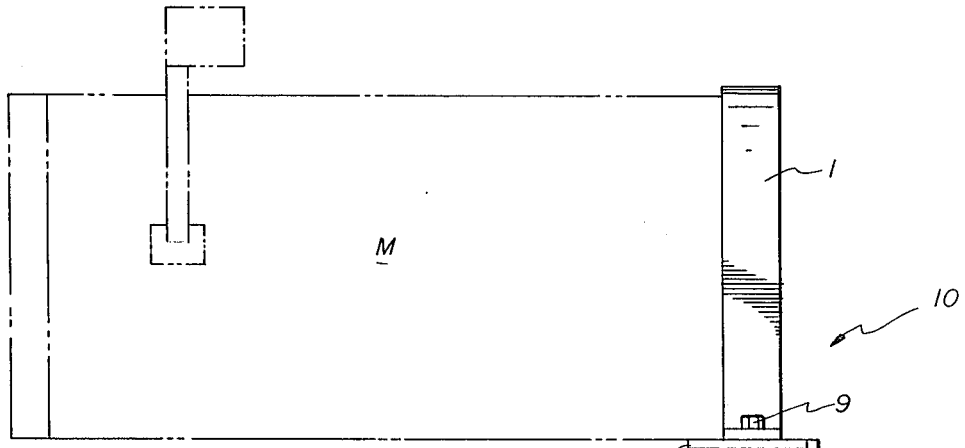

The delivery of mail on rural routes has often been a burdensome chore since the mail boxes may not always be conveniently placed to the road side, or alternatively the post which supports the mail box interfers with the postal vehicle's closely addressing the mail box. Moreover, when a post box is suitably placed so that it can be manipulated by the postman, the support structure associated with the mail box will not provide sufficient support so that opening the hinged door of the mail box will provide a torsion or distortion and a spring like effect further making the mail delivery chore nettlesome.

The following patents reflect the state of the art of which applicant is aware in so far as it appears germane to the subject invention:

U.S. Pat. no. 1,281,062, Norvell
U.S. Pat. No. 1,792,821, Cook
U.S. Pat. No. 3,272,465, Barrsgard
U.S. Pat. No. 3,827,626, Daigle
U.S. Pat. No. 4,105,180, Hodge.

Of these patents, Barrsgard appears to share the greatest coincidental structural similarity with the instant application since he discloses a swingable mail box mounted for pivotal movement on an upstanding post. Although a strap is provided for engagement of the mail box at one end various other components of the Barrsgard structure depart substantially from the instant invention, requiring far more components, a inordinately larger amount of time for installation, and a concomitant disadvantage in the reliability of the device.

The Daigle patent relates to a mail box support incorporating a pivoting and blocking mechanism and a door actuating mechanism both arranged into an integrated actuating assembly operated by a single handle.

The Norvell patent relates to a mail box support utilizing the straps or clamp members 8 of U-shaped configuration but such clamping members are utilized in conjunction with an angular brace 3 consisting of a horizontal leg 4 and a diagonal leg 5 mounted on an upper end of a post 1 for engagement with the clamping members 8.

The patent to Cook relates to a mail box supported in a conventional manner on a post 11 having a mechanism by means of which the box may be opened and closed through contact with a portion of the mail carrier's vehicle.

The Hodge patent discloses a mounting bracket for a newspaper delivery box which is mounted on a post 11, the mounting bracket comprising an elongated rectangular base 15 having a downwardly extending leg 24 and an arm 27 by means of which the box is mounted on a support structure 11.

None of these references teach singly nor renders obvious in combination the instant application which provides a rural mail box having a bracket which requires no wooden parts as is commonly found in devices on the market, in which the bracket is suitably fashioned to be used on a wood post, round or square or on a pipe as the support post, or in which the box can be surface mounted to a flat wall using lag screws. Not utilizing or requiring wood which deteriorates in the environment is one of the great advantages in the instant application.

OBJECTS AND SUMMARY OF THE INVENTION

Accordingly, this invention has as an object to provide support for a rural mail box which does not require the use of a wooden platform which traditionally underlies the mail box surface.

It is another object of this invention to provide a device of the character described above in which the bracket upon which the mail box is fastened is suitably fashioned to accommodate affixing to a post of any geometrical configuration, round or square, and can easily accommodate affixing to a pipe.

It is yet a further object of this invention to provide a device of the character described above in which the support bracket is suitably fashioned to also be mounted flush to a wall.

It is yet a further object of the invention to provide a device of the character described above in which the support mechanism of the mail box is suitably constructed to provide a cantilevered support rigid enough to allow manipulation of the mail box, while remotely placed from the access opening of the mail box to provide a postman with ease in addressing the mail box opening.

It is yet a further object of the invention to provide a device of the character described above which is substantially impervious to the elements, of durable construction, relatively inexpensive to manufacture, and extremely safe to use.

Theses and other objects will be made manifest when considering the following detailed specification when taken in conjunction with the appended drawing figures.

BRIEF DESCRIPTION OF THE DRAWING FIGURES

Figure 2:
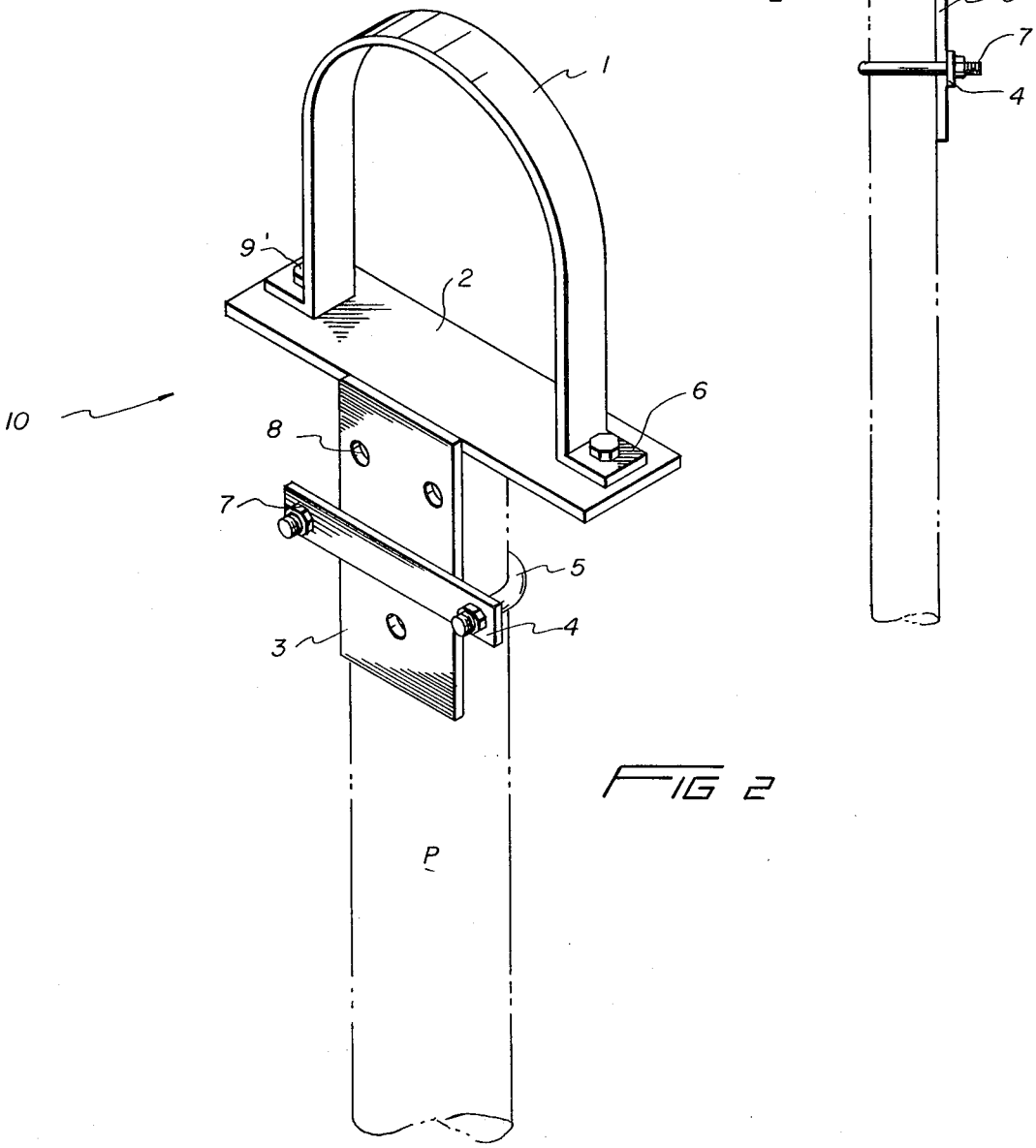

FIG. 1 is a side view of the apparatus according to the present invention; and FIG. 2 is a perspective view of that which is shown in FIG. 1.

BRIEF DESCRIPTION OF THE PREFERRED EMBODIMENT

Referring to the drawings now, wherein like reference numerals refer to like parts throughout the various drawing figures, reference numeral 10 is directed to the mail box brace according to the present invention.

The mail box brace 10 is shown in the drawing as having a substantially horizontal planar shelf 2 upon which an end portion of the mail box M rests. An inverted U-shaped strap 1 overlies the mail box and is fastened to the shelf by means of nut and bolt 9 which extends between opposed terminal outwardly extending horizontal flanges 6 of the U-shaped strap having apertures extending and registering with apertures within the shelf to allow the bolts easy passage therethrough.

Means for attaching the shelf 2 to a support post or to a wall includes a vertical plate 3 joined to the shelf 2 at respective edges so that a substantially L-shaped bracket is provided when viewed from the side as in FIG. 1. However, it is apparent from FIG. 2 that the extent of the shelf 2 is substantially greater than the vertical plate, for reasons to be assigned at this time. When fastening the brace to a wall, the vertical plate is provided with a plurality of holes 8 which can allow admission therethrough of lag bolts so that the device can be placed flush against the wall.

However, should the brace be affixed to a post, or pole, a horseshoe shaped clamp 5 is provided which has threaded termini passing through an apertured plate 4 so that nuts 7 can be threaded on the termini of the horseshoe clamp 5 by having the horseshoe clamp and the aperture plate straddle the post P and the vertical plate 3 to provide a firm means of retention.

In a preferred form of the invention, the choice of materials for affixing the mail box in this manner would be a metal that is impervious to the elements, although an inert type of plastic could also be suitably formed to provide adequate support. Also by means of the cantilevered construction shown in FIG. 1 in which the major portion of the mail box extends away from the support bracket, the postman is allowed easy access to the mail box while still remaining in the vehicle.

Further, having thus described the invention, it should be apparent that numerous structural modification are contemplated as being part of this invention described hereinabove and described hereinbelow by the claims.

What is claimed is:

1. A mail box brace comprising, in combination:

a horizontal planar shelf upon which an end portion of the mail box rests, an inverted U-shaped strap overlying the mail box and fastened to said shelf to firmly affix the mail box to said shelf.

and means for attaching said shelf to a support post wherein said strap has an opposed termini outwardly extending horizontal flanges for affixing to said shelf wherein said means for attaching said shelf to the support post comprises a vertical plate joined to said shelf at respective edges so that a substantially L-shaped bracket in cross section is provided.

2. The device of claim 1 wherein said vertical plate is provided with plural holes for insertion of screws therethrough to fasten to the post.

3. The device of claim 1 wherein said vertical plate is affixed to the post by means of a horseshoe clamp having threaded termini which pass through an apertured plate disposed on a face of said vertical plate opposite the post.

4. The device of claim 3 wherein said strap is fastened to said shelf and said horseshoe clamp is fastened to said apertured plate by a nut/bolt fastener.

5. The device of claim 4 wherein said shelf is somewhat wider than the mail box, and said vertical plate is less wide than said horizontal shelf.

* * * * *